US006218894B1

(12) United States Patent
De Langen et al.

(10) Patent No.: US 6,218,894 B1
(45) Date of Patent: Apr. 17, 2001

(54) VOLTAGE AND/OR CURRENT REFERENCE CIRCUIT

(75) Inventors: Klaas-Jan De Langen, Hoofddorp; Johan H. Huijsing, Schipluiden, both of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/396,564

(22) Filed: Sep. 15, 1999

(30) Foreign Application Priority Data

Sep. 18, 1998 (EP) ..... 98203138

(51) Int. Cl.[7] ..... G05F 1/10

(52) U.S. Cl. ..... 327/540; 327/541; 327/542; 327/543; 327/312; 327/315

(58) Field of Search ..... 327/538, 539, 327/540, 541, 543, 542; 323/312, 315

(56) References Cited

U.S. PATENT DOCUMENTS 3,962,592 * 6/1976 Tommen et al. ..... 327/538
4,435,678 * 3/1984 Joseph et al. ..... 323/315
5,304,918 * 4/1994 Khieu ..... 323/315
5,471,132 11/1995 Ryat ..... 323/315
5,481,180 1/1996 Ryat ..... 323/315
5,631,600 * 5/1997 Akioka et al. ..... 327/543
5,696,440 * 12/1997 Harada ..... 323/315
6,002,245 * 12/1999 Sauer ..... 323/315

OTHER PUBLICATIONS

H.C. Nauta et al, "New Class of High–Performance PTAT Current Sources", Electronics Letters Apr. 25, 1985, vol. 21, No. 9, pp. 384–386.

* cited by examiner

*Primary Examiner*—Terry D. Cunningham
(74) *Attorney, Agent, or Firm*—Brian J. Wieghaus

(57) ABSTRACT

A reference circuit contains a PTAT (Proportional To Absolute Temperature) core. In the PTAT core there is a difference between the currents densities flowing through a first and second transistor. This difference results in a difference in junction voltage in the first and second transistor. The currents are adjusted by a local feedback loop in proportion to one another until the difference in junction voltage equals a voltage drop across a resistor. According to the invention the currents to both transistors are supplied by current sources, and the currents are adjusted by deviating a fraction of the supplied current from the transistors. This makes it possible to reference all control voltages for the transistors and the local feedback loop to the same supply connection, which increases the stability and power supply rejection of the circuit.

11 Claims, 5 Drawing Sheets

VOLTAGE AND/OR CURRENT REFERENCE CIRCUIT

BACKGROUND OF THE INVENTION

1. Field of the Invention

The invention relates to an electronic circuit with a voltage and/or current reference circuit.

2. Description of Related Art

Such a circuit is known from an article titled "New class of high-performance PTAT current sources", by H. C.Nauta and E. H.Nordholt, published in Electronics letters Vol. 21 No. 9 pages 384 to 386, April 1985 (the Nauta article). FIG. 1 shows a PTAT reference circuit disclosed in the Nauta article.

At the core of this PTAT reference circuit are two transistors and a resistor. Furthermore, the circuit disclosed in the Nauta article uses two (high impedance) current sources. The current sources on the one hand and the transistors and the resistor on the other hand are connected to opposite power supply poles. Thus the current sources are able to supply proportionally adjustable currents I to the transistors and the resistor (that is, the currents are adjusted so that the proportion between these currents remains fixed).

The PTAT reference circuit makes use of the logarithmic relation between base emitter voltage Vbe and junction current density i of bipolar transistors:

$$Vbe=kT/q \log i/i0$$

Here "log" is the natural logarithm and i0 is a standard current density which is substantially the same for any transistor. In the known PTAT reference circuit unequal current densities i1, i2 (where i1=n*i2) are supplied to two transistors by supplying the same current I to two transistors whose junction area differs by a factor n. As a result, there is a fixed difference dV between the base emitter voltages in the two transistors:

$$dV=kT/q \log n$$

At the same time, the current I is fed through a resistor R, so that a voltage drop IR occurs through the resistor. A feedback loop adjusts the current supplied by the current sources so that the voltage drop compensates the dV difference between the junction. i.e. so that $$IR=kT/q \log n$$

Thus a reference current I is obtained.

The circuit disclosed in the Nauta article uses two (high impedance) current sources to supply the current I to the two transistors. This is in contrast to more conventional reference circuit designs, which use the (low impedance) input and (high impedance) output of a current mirror to supply the current I to respective ones of the transistors. By the use of two high impedance current sources, the Nauta article achieves high accuracy because it overcomes the detrimental consequences (e.g. supply voltage dependence) of the Early effect on the accuracy of the reference circuit.

However, it has been found that the reference circuit disclosed in the Nauta article has a potential instability problem, which can be overcome only by cumbersome additional circuits such as adding a relatively large capacitor between point A and Vnn. This capacitor undoes the elimination of the detrimental consequences of the Early effect at higher frequencies, because it causes an imbalance between the loads of the current sources; moreover the capacitor takes up circuit space.

BRIEF SUMMARY OF THE INVENTION

Amongst others, it is an object of the invention to provide for a circuit with a voltage and/or current reference circuit that achieves high accuracy and is stable even without a relatively large capacitor.

In the Nauta article, the feedback loop adjusts the currents from the current sources to obtain the desired current. This means that a voltage must be sensed on the transistors. This voltage is defined relative to the power supply pole of the transistors and the resistor. The sensed voltage must then be used to generate a control voltage for the current sources. This control voltage is defined relative to power supply pole of the current sources. Thus a shift of voltage reference is needed. It has been found that the circuits needed to shift from the one reference to the other give rise to the instability if no cumbersome measures are taken.

The need for this shift of voltage reference is removed by adjusting the current flowing the transistors by deviation of current through a deviation circuit which is connected to the same power supply pole as the transistors and the resistor. Thus stability is improved without a capacitor, at the price of a slightly increased current consumption, whereas the high accuracy may be retained. As a further advantage, the circuit does not need an additional startup circuit, as is the case for conventional PTAT current reference circuits.

These and other advantageous aspects of the invention will be described using the attached figures.

DETAILED DESCRIPTION OF THE INVENTION

Figure 1:
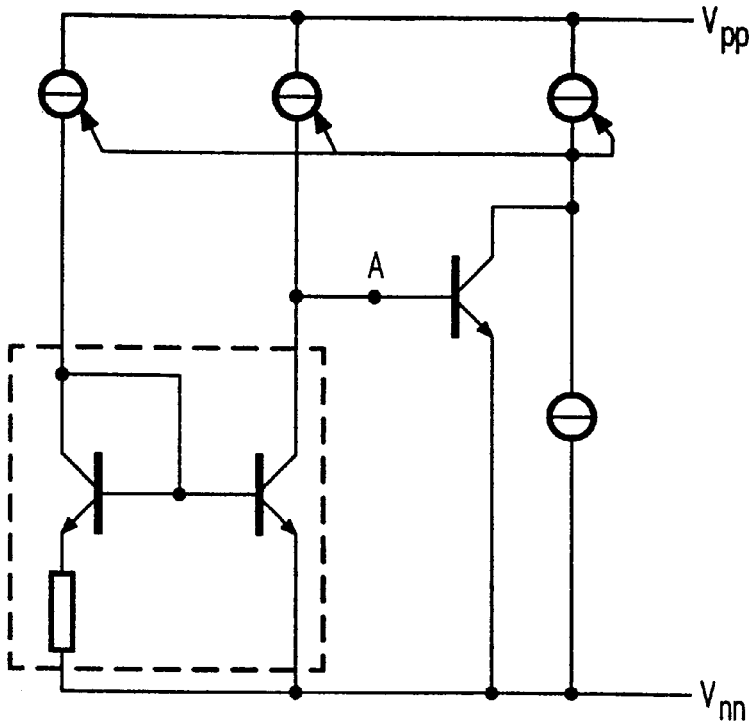
FIG. 1 PRIOR ART
FIG. 1 shows a prior art reference circuit.
Figure 2:
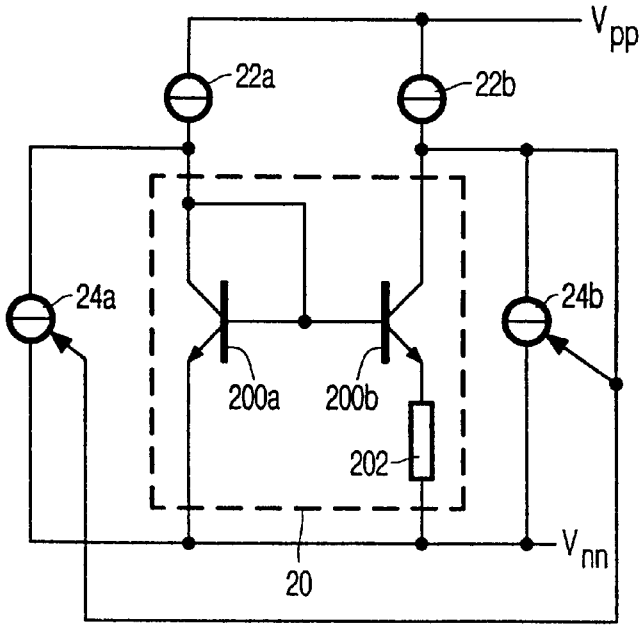
FIG. 2 shows a first embodiment of the reference circuit according to the invention.

FIG. 2 shows a reference circuit according to the invention. The circuit contains a PTAT core 20, which comprises a first NPN transistor 200*a*, a second NPN transistor 200*b* and a resistor 202; the emitter area of the second transistor 200*b* is a factor n larger than the emitter area of the first transistor 200*a*. In addition the circuit contains four current sources 22*a,b*, 24*a,b*. The circuit has a positive power supply connection Vpp and a negative power supply connection Vnn.

The collector of the first transistor 200*a* is connected to the positive power supply connection Vpp via the first current source 22*a*. The emitter of the first transistor 200*a* is connected to the negative power supply connection Vnn.

The collector of the second transistor 200*b* is connected to the positive power supply connection Vpp via the second current source 22*b*. The emitter of the second transistor 200*b* is connected to the negative power supply connection Vnn via the resistor.

The base connections of the first and second transistor 200*a,b* are connected together and to the collector of the first transistor 200*a*.

The third and fourth current source 24*a,b* are connected between the negative power supply Vnn and the collector of the first and second transistor 200*a,b* respectively. A control input of the third and fourth current source 24*a,b* are connected together and to the collector of the second transistor 200*b*.

In operation the PTAT core 20 imposes that the base-emitter voltage of the first transistor 200*a* is equal to the sum of the voltage drop across the resistor 202 and the base-emitter voltage 200*b* of the second transistor. As a consequence the natural logarithm of the ratio of the currents I1, I2 through the collector of the first and second transistor 200*a,b* to the negative power supply is $$\log \mathbf{I1}/\mathbf{I2}=\mathbf{I2}*R*q/kT-\log n$$

where R is the resistance value of resistor 202 and n is the ratio of the emitter areas of the transistors 200*a,b*.

The connection between the collector and the base of the first transistor 200*a* ensures that the sum of the currents at the collector of the first transistor is zero.

The first and second current source each supply a current I from the positive power supply to the collector of the first and second transistor 200*a,b* respectively. Part I1, I2 of these currents flows through the collector-emitter of the first and second transistor 200*a,b* and through the resistor 202. A fraction of these currents is deviated from the transistors 200*a,b* by the third and fourth current source 24*a*,24*b*.

The fraction is controlled by the voltage at the collector of the second transistor 200*b* and reaches a stationary value once the currents I1, I2 through the first and second transistor are equal, that is when $$\mathbf{I2}*R*q/kT=\log n$$

Thus, a current 12 is realized that depends on absolute temperature T, but not on material properties of the transistors. Both the voltage at the collector of the first transistor 200*a* and that at the collector of the second transistor 200*b* are defined with respect to the same power supply Vnn (through the properties of the first transistor 200*a* and the control input of the fourth current source 24*b* respectively). Because these voltages are defined with respect to the same reference (Vnn), the circuit is hardly susceptible to the effects of a wide frequency range of power supply variations, effects due e.g. to the Early effect in the transistors 200*a,b*. No start-up current is needed and no capacitor is needed to make the circuit stable.

The voltage at the collector of the first transistor 200*a* may be used as a reference voltage.

Figure 3:
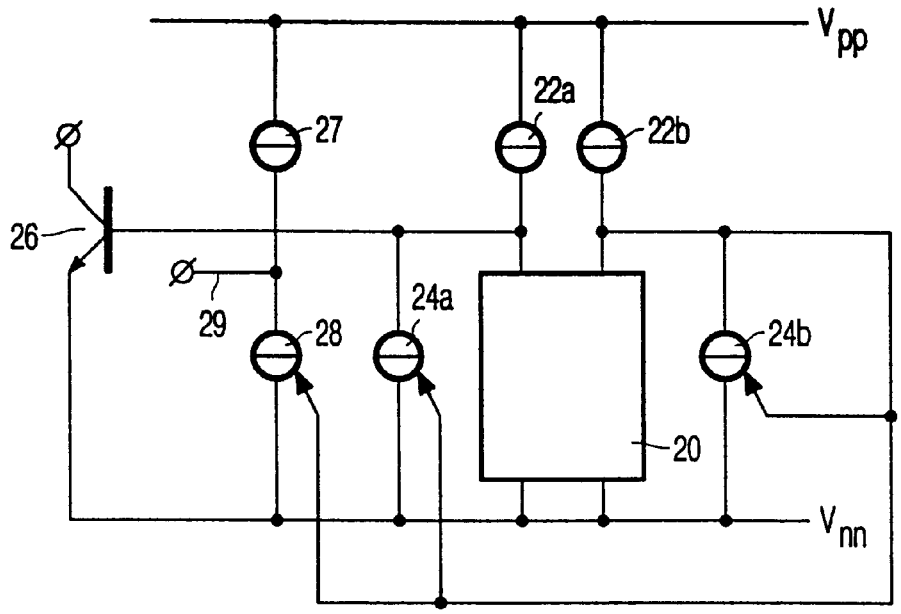
FIG. 3 shows a reference circuit with a reference current output.

FIG. 3 shows how reference currents may be obtained. A further transistor 26 is included with properties similar to those of the first transistor 200*a* and having an emitter and base connected to the emitter and base of the first transistor 200*a*. From the collector of this further transistor 26 flows a current I1.

A current from the positive supply connection Vpp is obtained by a first and second output current source 27, 28. An output node 29 is connected to the positive and negative supply connections Vpp, Vnn through the first and the second output current source 27, 28 respectively. A control input of the second output current source is connected to the control inputs of the third and fourth current source 24*a,b*.

In operation, the first output current source supplies the same current I as the first and second current source 22*a,b*. The second output current source supplies the same current (I-I1) as the third and fourth current source 24*a,b*. As a result the net current at the output node 29 is I1.

Dependent on the need for reference current sources either further transistor 26 or the combination of output current sources 27, 28 or both may be used.

Various versions of the PTAT core may be used. For example, one may use transistors 200*a,b* with the same emitter area, provided the current supplied by the first current source 22*a* is a factor n larger than that supplied by the second current source 22*b*. In this case, the third and fourth current source 24*a,b* must also be proportioned with a ratio n: 1 so that they deviate the same fractions of the current from the positive power supply Vpp supplied by the first and second current source 22*a,b* respectively.

Similarly additional resistors may included, for example in the emitter path of the first transistor 200*a*.

All kinds of combinations of different currents and emitter areas may be used. What matters is that the junction current densities through the first and second transistor 200*a,b* differs and that the resulting difference in base-emitter voltage is the same as a resistive voltage drop IR, which is proportional to the controlled current. Furthermore third and fourth current source should deviate the same fractions of the currents supplied to the PTAT core.

Figure 4:
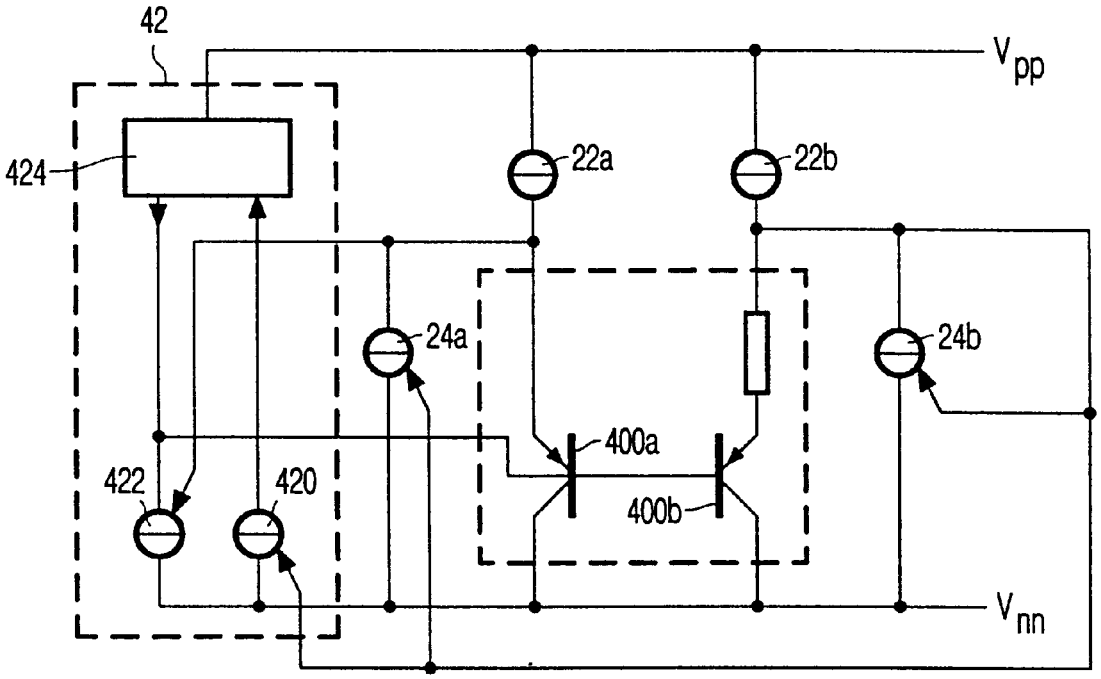
FIG. 4 shows a reference circuit with another PTAT core.

FIG. 4 shows another PTAT core 400 this time with a first and second PNP transistor 400*a,b* and a resistor 402. The collectors of the PNP transistors 400*a,b* are connected to the negative power supply Vnn. The emitter of the first PNP transistor 400*a* is connected to the positive power supply through the first current source. The emitter of the second PNP transistor 400*b* is connected to the positive power supply Vpp through the resistor, a node 404 and the second current source 22*b*. The bases of the transistors 400*a,b* are connected together. The emitter of the first transistor 400*a* and the node 404 are connected as the outputs of the PTAT core 400 in the same way as the collectors of the npn transistors 200*a,b* of FIG. 2.

In addition, the circuit of FIG. 4 contains a base voltage control circuit 42. The base voltage control circuit 42 has an input connected to the emitter of the first transistor 400*a* and a high impedance output connected to the base of the first transistor 400*a*.

The base voltage control circuit 42 contains a first and second base control current source 420, 422 and a current mirror 424. The current mirror 424 has a supply connection connected to the positive supply connection Vpp. The input and output of the current mirror is connected to the negative supply connection Vnn through the first and second base control current source 420, 422 respectively.

A control input of the first base control current source 420 is connected to the control inputs of the third and fourth current sources 24*a,b*. A control input of the second base control current source 422 is connected to the emitter of the first transistor 400*a*.

In operation, the function of the base voltage control circuit 42 is to make the emitter voltage of the first transistor 400*a* equal to the voltage at the node 404 between the resistor 402 and the second current source 22*b*. To do this, the base voltage control circuit 42 adjusts the base voltage of the transistors 400*a,b* until the net current at the emitter of the first transistor 400*a* is zero. In this respect the base voltage control circuit 42 takes over the function of the connection between the collector and base of the first transistor 200*a* of FIG. 2.

The first base control current source 420 supplies the same current I-I2 as the third and fourth current source 24*a,b* and the current supplied by the second base control current source 422 is adjusted so that it supplies the same current as the third and fourth current source 24*a,b*. This is realized when the voltage at the emitter of the first transistor 400*a* equals the voltage at the node 404.

The current sources can be realized in various conventional ways. One may use for example bipolar transistors with an emitter connected to the supply, optionally via a resistor, a collector coupled to the output of the current source and a base used as control input. Instead of bipolar transistors MOS transistors may be used. Preferably, the MOS transistors are cascoded, at least in the third and fourth current source 24*a,b* and in the first and second base control current sources 420, 422. A control voltage for cascode transistors may be derived for example from the output of the current mirror 424.

In this respect the FIG. 4 is very suitable for MOS implementation, because PNP transistors 400*a,b* can be realized in a CMOS process. Instead of the transistors 400*a,b* or 200*a,b* MOS transistors may be used, but then the reference voltage and current depend on carrier mobility.

The reference circuit according to the invention may also be converted to a bandgap reference, by adding a resistive voltage drop to the reference voltage across the base-emitter the transistor 200*a* etc.

Figure 5:
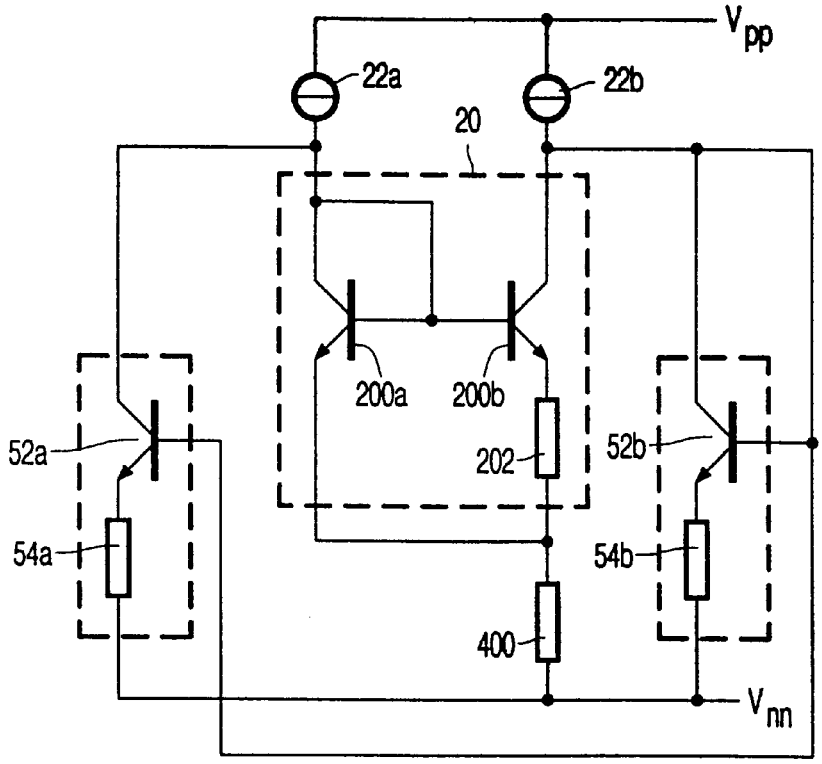
FIGS. 5, 5*a* show bandgap reference circuits.

FIG. 5 shows a bandgap reference circuit according to the invention. Here a further resistor 50 has been included between the negative power supply Vnn on one hand and a connection between the resistor 202 and the emitter of the first transistor 200*a* on the other hand. The components of third and fourth current source 24*a,b* are shown explicitly. Each contains a transistor 52*a,b* and a resistor 54*a,b* connected between the emitter and Vnn. The resistors 54*a,b* serve to raise the collector voltage of the second transistor 200*a,b* so that it does not become too low now that the emitter voltages are raised by the further resistor 400; preferably the value of the resistors 54*a,b* is selected so that the collector voltages of the first and second transistor 200*a,b* are substantially equal. (Alternatively, the two resistors 54*a,b* may be merged in a single resistor connecting the emitters of both transistors 52*a,b* to Vnn).

The value of the further resistor 400 may be chosen in a known way to ensure a bandgap reference voltage $$Vbe/R400+2*I1$$

(approximately 1.2V) at the collector of the first transistor 200*a* relative to Vnn.

Figure 5A:
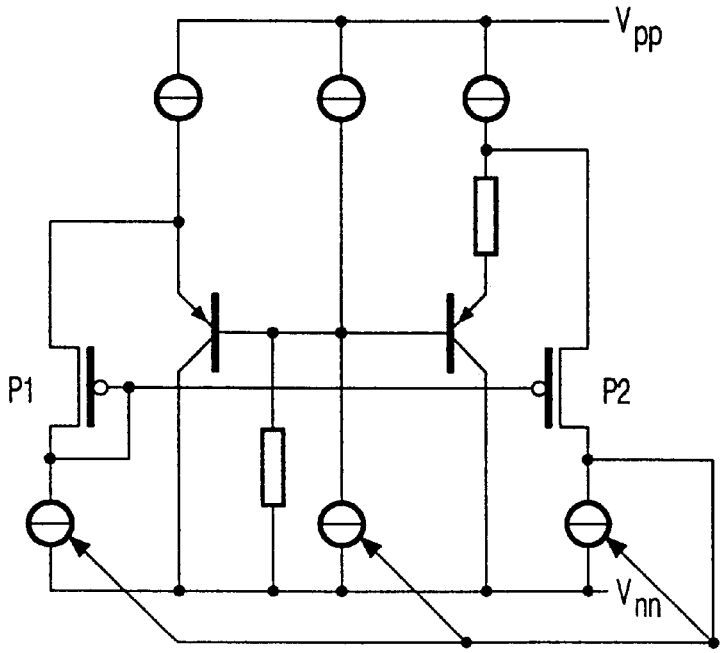

FIG. 5*a* shows a CMOS version of this bandgap reference circuit. Here, P1, P2 function as a feedback amplifier to steer the deviation currents under control of the difference between the voltages of the emitter of one PNP transistor and the PTAT resistor connected to the emitter of the other PNP transistor.

Figure 6:
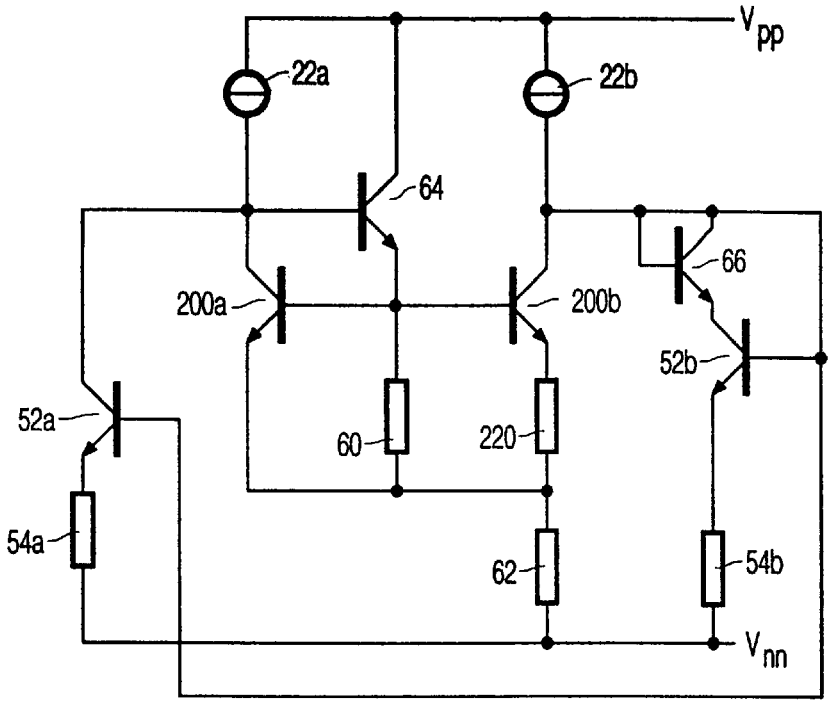
FIGS. 6, 6*a* show further bandgap reference circuits.

FIG. 6 shows an alternative voltage reference circuit. Here a further resistor 60 is coupled in parallel to the base-emitter junction of the first NPN transistor 200*a*. A common resistor 62 couples the connection of the resistor 202, the emitter of the first NPN transistor 200*a* and the further resistor 60. A further NPN transistor 64 has its base coupled to the collector of the first NPN transistor 200*a*, its emitter coupled to the base of first NPN transistor 200*a* and its collector connected to the positive power supply Vpp. A diode transistor 66 is coupled between the collector of the second NPN transistor 200*b* and the collector of the transistor 52*b* in the fourth current source.

In operation the current through both NPN transistors 200*a,b* and the further resistor is collected as a current $$IC=2*I1+Vbe/R60$$

In the circuit of FIG. 6 the product IC*R60 takes the place of the bandgap voltage of FIG. 5: the further resistor R60 is selected in a similar way as further resistor 400 of FIG. 6. By means of the common resistor 62, the current IC can be converted into any desired voltage.

The further NPN transistor 64 serves to compensate the current drawn by the further resistor 60. The voltage at the collector of the first NPN transistor 200*a* will change until the current through the further transistor 60 is substantially equal to the current through the further resistor 60. The diode transistor 64 introduces a voltage level shift which serves to keep the voltage at the collector of the first and second transistor 200*a,b* substantially equal, so as to minimize the consequence of the Early effect on the reference current.

Instead of the further transistor 64 one may also use a compensation resistor in parallel with the collector emitter of the transistor 52*b* in the third current source to compensate the current through the further resistor. This allows the circuit to operate at a lower supply voltage, but it requires resistor matching. In this case, the collector and base of the first NPN transistor 200*a* may be connected to each other and the diode transistor may be replaced by a direct connection.

The compensating resistor should have the same value as the further resistor, in order to draw the same current from the collector of the second NPN transistor 200*b* as the further transistor draws from the collector of the first NPN transistor 200*a*.

Figure 6A:
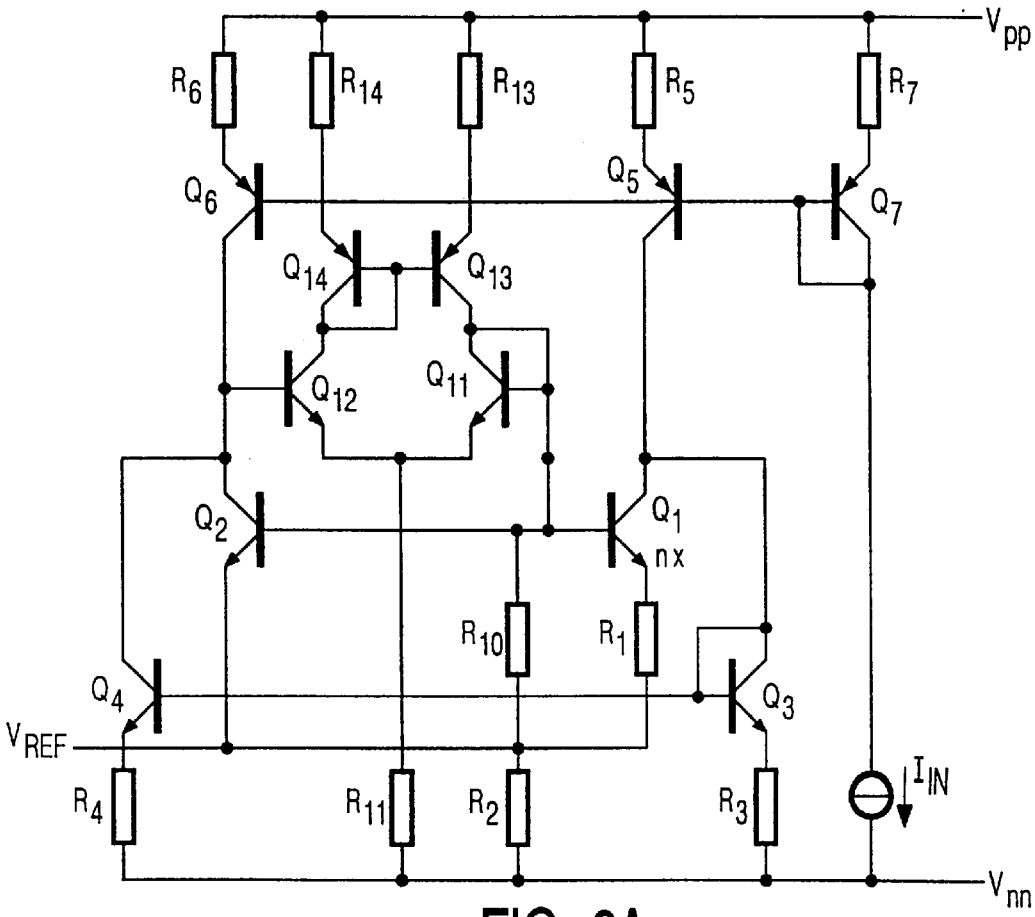

Alternatively, the function of transistor 64 may be replaced as shown in the circuit of FIG. 6*a*. In this circuit, the function of transistor 64 is replaced by an amplifier circuit Q11, Q12, Q13, Q14, R13, R14. This circuit is suitable for lower supply voltages, because it eliminates the base-emitter voltage drop of transistor 64 in the critical supply path from Vpp through the base emitter junction of first transistor 200*a* to Vnn. Instead, only the collector-emitter voltage drop of Q13 (plus the drop over R13) occurs in this path.

The circuit of FIG. 6 is more accurate than the version with the compensating resistor. In addition, the further transistor 64 provides a buffering of the base voltage of the first and second transistor 200*a,b*, so that this voltage may be used as an output voltage.

The buffer transistor 64 can also be applied to other versions of the circuit, that is, not only if a further resistor 60 is present in parallel to the base emitter junction of the first transistor 200*a* (as in FIG. 6). Generally, the buffering serves to ensure that a current drawn from the base (such as an output current) does not affect the accuracy of the circuit. One may for example use a current bias circuit for the buffer transistor 64 between the base of the first transistor 200*a* and Vpp to drain a quiescent current of the further transistor 64. Preferably, the bias circuit matches the third and fourth current source, e.g. by using a series arrangement of a resistor and a diode.

Figure 7:
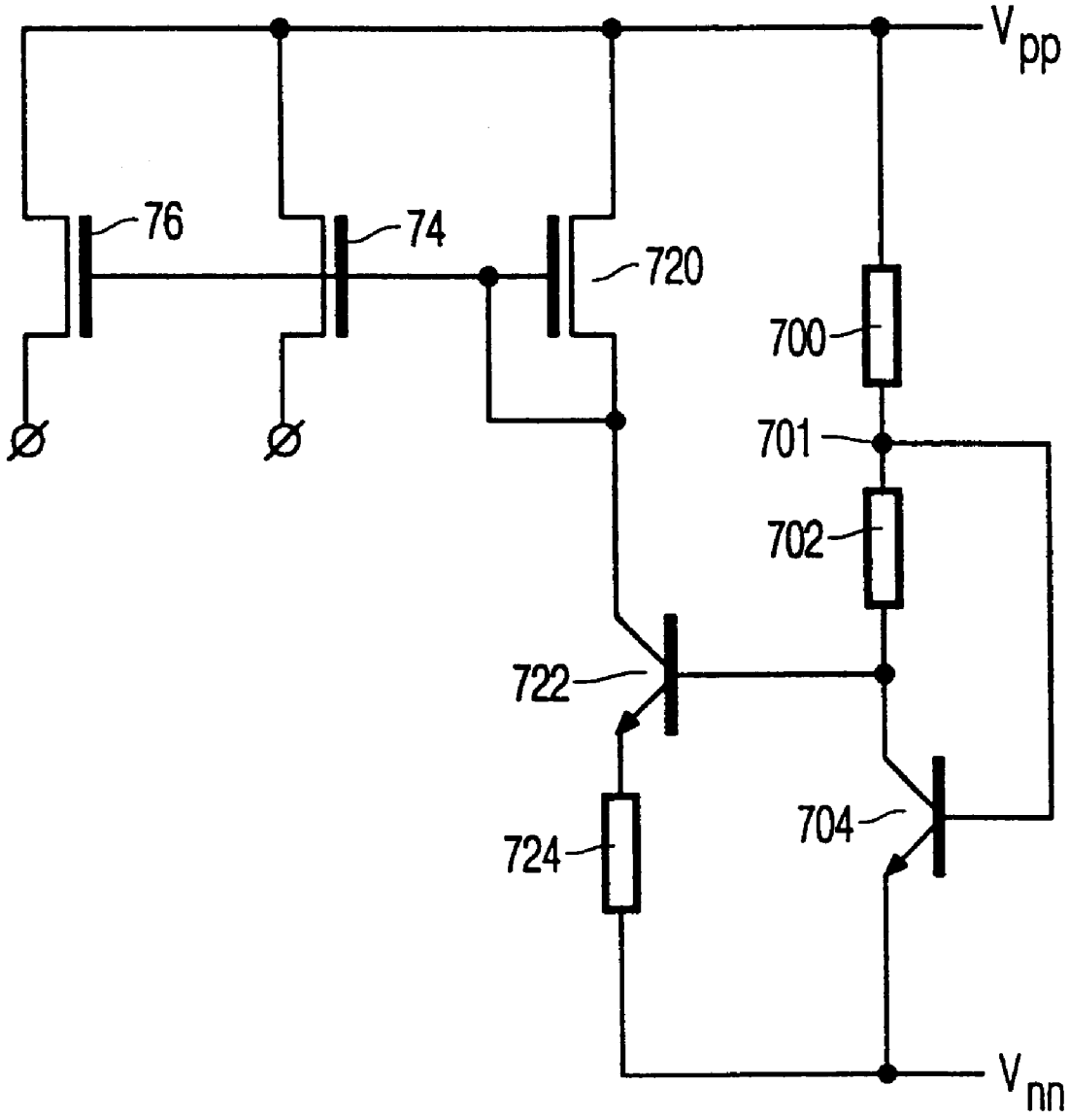
FIG. 7 shows a set of current sources for use in a reference circuit.

FIG. 7 shows a circuit which may be used for realizing the first and second current source 22*a,b*. This circuit contains a first branch between Vpp and Vnn of successively a resistor 700, a node 701, a resistor 702 and the collector-emitter of an NPN transistor 704, the base of the transistor 704 being coupled to the node 701.

A second branch between Vpp and Vnn contains the channel of a PMOS transistor 720, the collector emitter of an NPN transistor 722 and a resistor 724. The collector of the transistor 704 in the first branch is coupled to the base of the NPN transistor 722 in the second branch. This NPN transistor 704 has twice the emitter area of the transistor 704 in the first branch.

The drain of the PMOS transistor 720 is coupled to its gate and to the gate of a number of further PMOS transistors 74, 76 which serve as first and second current source.

What is claimed is:

1. An electronic circuit with a reference circuit, the reference circuit comprising a core circuit that includes:

a first and second transistor and a resistor, each of the first and second transistors providing a current path to a reference voltage, the resistor being coupled to one of the first and second transistors so as to affect current flow through the current path of the one of the first and second transistors, current sources that are configured to supply currents through the each of the current paths of the first and second transistors, and a current deviation circuit that is configured to deviate a same adjustable fraction of each of the currents supplied by the current sources around each of the current paths of the first and second transistors, to the common reference voltage, wherein a feedback signal from the core element is arranged to adjust the fraction such that current flowing through the resistor compensates for a difference in current densities between the first and second transistors, so that an equal current flows into the current paths of the core element.

2. An electronic circuit according to claim 1, wherein the current deviation circuit comprises a current mirror, the current mirror including an input and an output, a node for deviating said fraction from the current path of the first transistor being connected to the input via a coupling that passes said fraction so that a voltage at the node follows a voltage at the input, the output being coupled to a node for deviating said fraction from the current path of the second transistor.

3. An electronic circuit according to claim 2, wherein the input clamps a collector voltage of the first transistor relative to a supply voltage, and the second transistor has a base and a collector with a mutual coupling that clamps the collector voltage relative to said supply voltage.

4. An electronic circuit according to claim 1, wherein the first and second transistors are bipolar transistors, each transistor having a collector, an emitter and a base, the collectors of each being connected to the current sources, the bases of each being coupled to each other, and the emitters of each being connected via the resistor.

5. An electronic circuit according to claim 4, comprising a buffer transistor coupled between the collector and base of the first transistor.

6. An electronic circuit according to claim 1, wherein the first and second transistors are bipolar transistors, each transistor having a collector, an emitter and a base, the bases being coupled to each other, the collectors being coupled to each other, and the emitters of the first and second transistor being coupled to a first and second node at the output of respective ones of the current sources respectively, the resistor being coupled between the first node and the emitter of the first transistor, the circuit comprising a feedback loop for keeping voltage at the first and second nodes equal to one another.

7. An electronic circuit according to claim 1, comprising a second resistor, connected so that the currents from both the first and the second transistor flow through the second resistor, and a sum of a voltage across the second resistor and a junction voltage of the first or second transistor being supplied to a voltage reference output.

8. An electronic circuit according to claim 1, comprising a second resistor in parallel with a junction of the first transistor, and a summing circuit for summing currents through the second resistor and the first and second transistor, a sum current through the summing circuit serving as a reference current.

9. An electronic circuit with a reference circuit, the reference circuit comprising:

a core element having a first current path and a second current path to a reference voltage, each of the first and second current paths having different current densities, a first current source and a second current source that are configured to supply a first current and a second current, respectively, the first current source providing a first reference current to the first current path, and the second current source providing a second reference current to the second current path, and a first current deviation circuit and a second current deviation circuit that are each configured to deviate a same fraction of each of the first and second currents supplied by the first and second current sources around the first and second current paths to the reference voltage, respectively, the fraction being based on a feedback signal from the core element, and the feedback signal is configured to equalize the first reference current and the second reference current flowing through the first and second current paths, respectively.

10. The electronic circuit of claim 9, wherein the core element comprises a first transistor, a second transistor, and a resistor, the base of each of the first and second transistors being coupled together, and the first current path includes a collector-emitter current path of the first transistor, and the second current path includes a collector-emitter current path of the second transistor and the resistor.

11. A method of providing a Proportional To Absolute Temperature (PTAT) reference signal, comprising:

providing equal currents from a first and second current source, to a first and second current path of a PTAT core circuit, to a reference voltage, and diverting equal adjustable portions of current from each of the first and second current paths to the reference voltage, based on a feedback signal from the PTAT core circuit, relative to the reference voltage, wherein the feedback signal is selected so as to adjust the equal adjustable portions of current until current flowing through each of the first and second current paths is equal, thereby providing the PTAT reference signal.

* * * * *